US008622808B2

(12) United States Patent
Pececnik et al.

(10) Patent No.: US 8,622,808 B2
(45) Date of Patent: Jan. 7, 2014

(54) THREE-WHEEL WAGERING DEVICE AND METHOD

(75) Inventors: Joze Pececnik, Smarca (SI); Jamie Abrahamson, Las Vegas, NV (US)

(73) Assignee: Elektroncek D.D., Menges (SI)

( * ) Notice: Subject to any disclaimer, the term of this patent is extended or adjusted under 35 U.S.C. 154(b) by 0 days.

(21) Appl. No.: 13/479,690

(22) Filed: May 24, 2012

(65) Prior Publication Data

US 2013/0316781 A1 Nov. 28, 2013

(51) Int. Cl.
*G07F 17/32* (2006.01)

(52) U.S. Cl.
USPC ..... 463/20; 463/16; 463/25

(58) Field of Classification Search
USPC ..... 463/16–25; 273/192, 292
See application file for complete search history.

(56) References Cited

U.S. PATENT DOCUMENTS

| | | | | |
|---|---|---|---|---|
| 6,890,255 | B2 | 5/2005 | Jarvis | |
| 7,425,177 | B2 * | 9/2008 | Rodgers et al. | 463/20 |
| 7,553,233 | B2 | 6/2009 | Jarvis | |
| 8,308,547 | B2 * | 11/2012 | Walker et al. | 463/17 |
| 2004/0077398 | A1 | 4/2004 | Jarvis | |
| 2005/0215307 | A1 | 9/2005 | Jarvis | |
| 2011/0059789 | A1 * | 3/2011 | Luciano | 463/20 |
| 2011/0159942 | A1 * | 6/2011 | Cram | 463/17 |
| 2011/0218029 | A1 * | 9/2011 | Rodgers et al. | 463/20 |
| 2011/0223987 | A1 * | 9/2011 | Rodgers et al. | 463/20 |

* cited by examiner

*Primary Examiner* — Masud Ahmed
(74) *Attorney, Agent, or Firm* — Mark A. Litman & Associates, P.A.

(57) ABSTRACT

A wagering game is played with three wheels having three parallel but not coincident axes of rotation. Each wheel is spun so they are spinning at the same time. Wagers are placed on any one, two or three of the spinning wheels to predict outcomes of symbol identification on each of the wheels. Each wheel may be similar to a Big 6 wheel.

20 Claims, 3 Drawing Sheets

THREE-WHEEL WAGERING DEVICE AND METHOD

BACKGROUND OF THE INVENTION

1. Field of the Invention

The present invention relates to the field of wagering devices and methods, and novel wagering systems and methods related to big wheel or candy wheel type games.

2. Background of the Art

One of the more common wagering devices that has remained popular over the years is the spinning wheel, also known as the candy wheel. One of the more common upright spinning wheel devices in the gaming industry is the Big 6 wheel, in which usually six different types of symbols are distributed randomly about a wheel, each of the symbols being present in different proportions or frequencies on the wheel. The different symbols are either physically or virtually (in electronic format) separated from each other by pegs, and a usually fixed position pointer is used to determine the game event outcome, with the pointer identifying the symbol resulting from the game spin.

One common variant of this game is a large wheel with more than 30 spaces available on the face of the wheel, and each space is identified with a specific denomination of currency. In the US, for example, the wheel will have slots of $1, $2, $5, $10, $20 and $50 (for example). A wager is placed on a specific denomination (e.g., a $1.00 or more wager) and if the correct denomination is chosen for the result of the spin, the wager is resolved proportionally to the wager and the denomination. That is, for a $2.00 wager on the $5 outcome, the payout would be $2.00×$5, or $10.00. The distribution and number of denomination symbols is such that there is a built in house advantage. The statistical long-range frequency of $1 appearing is less than 1:1, and so forth, through the statistical long-range frequency of the $50 denomination outcome being less than 1:50.

Numerous variations of these types of games have been tried. U.S. Pat. No. 7,601,061 (Jackson) discloses an apparatus and method for operating a gaming device, said method comprising: for a single play of a game: enabling a wager to be placed on a payline; causing a display device to display a plurality of areas, each of said areas divided into a plurality of sub-areas; for at least one but less than all of the sub-areas of each of the areas, randomly determining a symbol from a plurality of different symbols into display in said sub-area, and causing the display device to display said randomly determined symbol in said sub-area; for each of said areas, randomly determining one of the sub-areas of each of the areas which defines the payline, and causing the display device to display an indication of said randomly determined sub-areas which define the payline, wherein for each of said areas, the random determination of any symbol to display in any sub-area of said area is separate from the random determination of which sub-area of said area defines the payline; and determining if any randomly determined and displayed symbols in the sub-areas which define the payline are one of a plurality of winning symbol combinations, and if any randomly determined and displayed symbols along the payline are one of said plurality of winning symbol combinations, causing the display device to display an award for said winning symbol combination.

Other variations are shown in Published U.S. Patent Application Document No. 20050215307 (now U.S. Pat. No. 7,553,233) and Published U.S. Patent Application Document No. 20040077398 and U.S. Pat. No. 6,890,255 (Jarvis, Eugene, et al.), "Multiple wheel roulette game."

SUMMARY OF THE INVENTION

A Three-Wheel gaming system is provided wherein there are three physical and/or virtual wheels that have multiple symbol positions on the wheels that are used to independently determine game event outcomes on each of the three wheels. At least one wager is placed on any single wheel, any two wheels or all three wheels. The three wheels are then spun (physically or virtually), the individual wheel symbol outcomes are determined and the wagers are resolved according to the rules of the game that determine payouts on the wagers(s).

A wagering game is played with the three wheels having three parallel but not coincident axes of rotation. Each wheel is spun so they are spinning at the same time. Wagers are placed on any one, two or three of the spinning wheels to predict outcomes of symbol identification on each of the wheels. Each wheel may be similar to a Big 6 wheel.

DETAILED DESCRIPTION OF THE INVENTION

Figure 1:
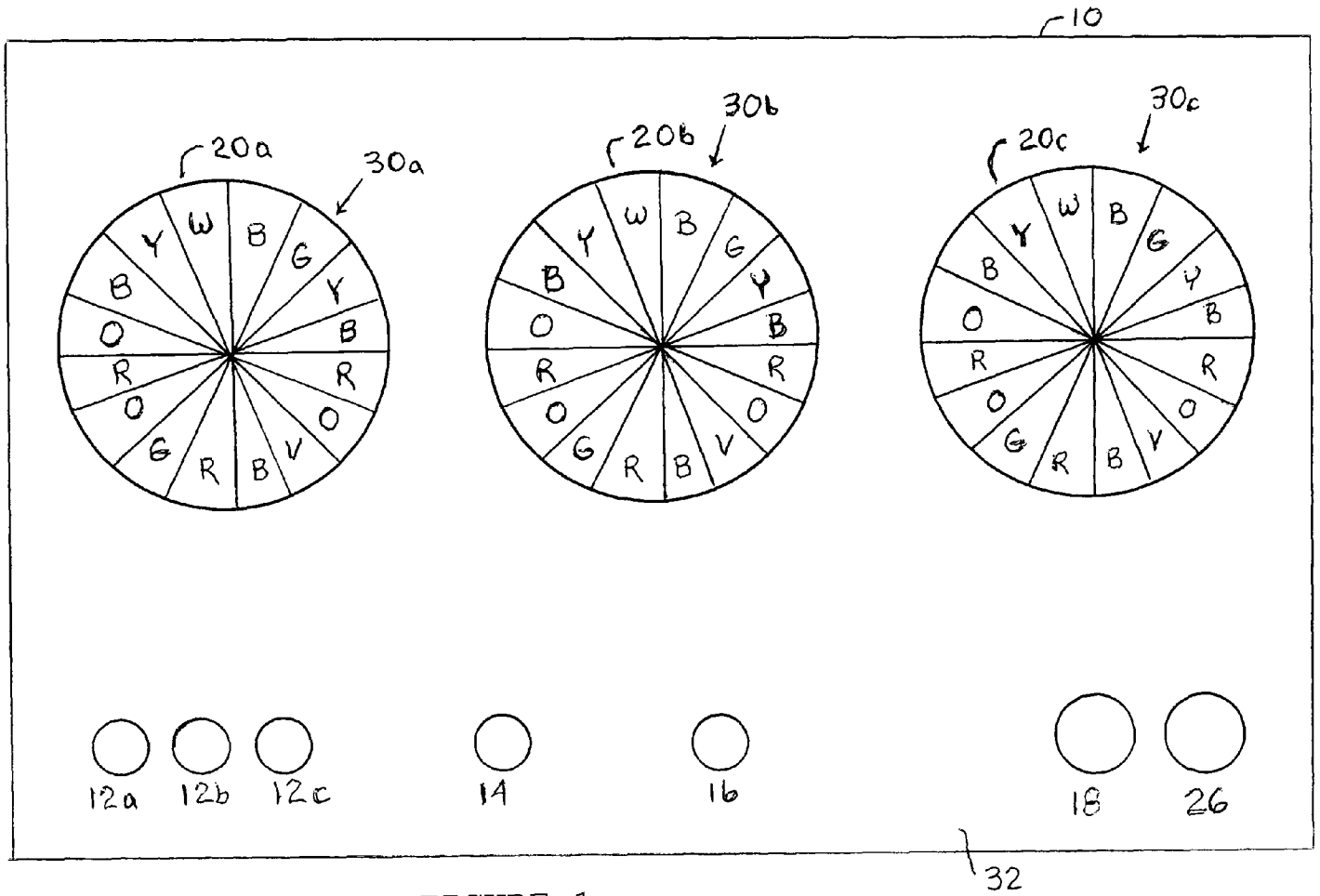
FIG. 1 shows a frontal view of a gaming device having three independent wheel gaming devices thereon.
Figure 2:
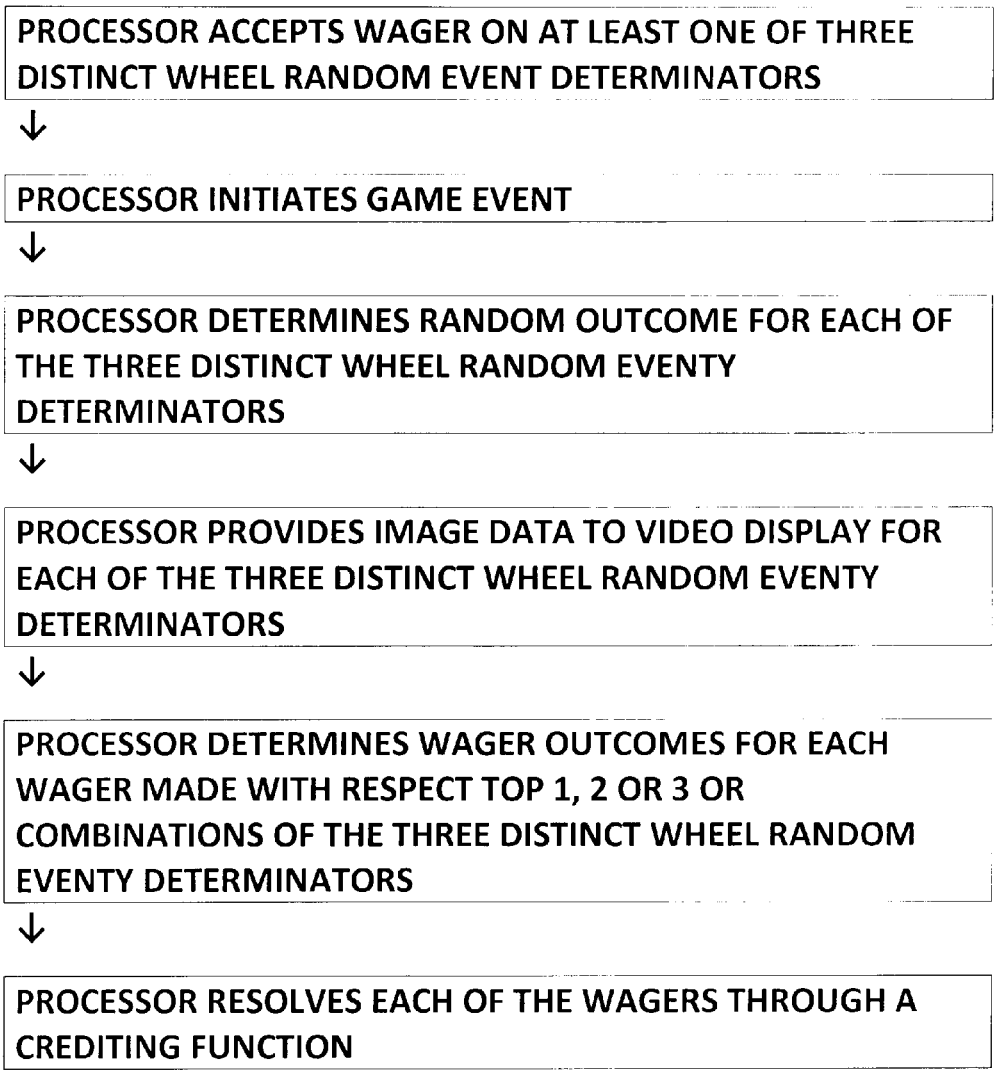
FIG. 2 is a flow diagram of a method according to the present invention.

An at least Three-Wheel gaming system is provided wherein there are three physical and/or virtual wheels that have multiple symbol positions on the wheels that are used to independently determine game event outcomes on each of the three wheels. At least one wager is placed on any single wheel, any two wheels or all three wheels. The three wheels are then spun (physically or virtually), the individual wheel symbol outcomes are determined and the wagers are resolved according to the rules of the game that determine payouts on the wagers(s).

One way of describing games according to the present technology is as a method of providing a wagering game and resolving wagers on that wagering game that includes at least:

a) providing three independently spinning wheel outcome providers, each spinning wheel outcome provider having more than thirty outcome positions on each wheel;
b) each outcome position on the wheel having a symbol therein;
c) each spinning wheel outcome provider positioned on a gaming apparatus so that all symbols on a face of each spinning wheel outcome provider are viewable at the same time from a position in front of the gaming device;
d) each spinning wheel outcome provider having at least six different types of symbols displayed on the face of the spinning wheel outcome provider;
e) the gaming apparatus comprising the three spinning wheel outcome providers, a processor, memory accessible by the processor, and the processor configured to execute code to perform a method comprising:
   i) recognizing a wager on the wagering game in which the wager places value at risk on the determination of at least one outcome selected from the group consisting of 1) a specific symbol appearing on a specific spinning wheel outcome provider; 2) any symbol appearing on any two spinning wheel outcome providers; 3) any single symbol appearing on all spinning wheel outcome providers; and 4) a specifically selected single symbol appearing on all spinning wheel outcome providers;

ii) spinning each of the spinning wheel outcome providers;

iii) identifying a specific symbol outcome on each spinning wheel outcome provider; and iv) resolving any wager recognized in i) based upon the identification of each specific symbol outcome on each spinning wheel outcome provider.

Each spinning wheel outcome provider may consist of a physical spinning wheel with an axis or rotation perpendicular to the face of the spinning wheel outcome provider, or each spinning wheel outcome provider consists of a virtual spinning wheel with an axis or rotation perpendicular to the face of the spinning wheel outcome provider which is displayed on a video display system. Two separate wagers may be recognized at a single player position, the two separate wagers comprising a) at least one wager on an outcome of a specific symbol on a specific wheel, a specific symbol on at least two wheels, or a specific symbol on three wheels and b) an outcome of any specific symbol on three wheels or any single symbol on all three wheels. Two separate wagers may be recognized at a single player position, the two separate wagers comprising a) at least one wager on an outcome of a specific symbol on a specific wheel, a specific same symbol on at least two wheels, or a specific same symbol on three wheels and b) an outcome of any same specific symbol on three wheels or any same symbol on all three wheels. Multiple wagers of equal or different amounts may be placed different wheels and different symbols on the different wheels. That is, there may be a $5.00 wager on Yellow on wheel 2, and a $10.00 wager placed on Red on wheel 3.

A preferred system may include one or more of the following components.

1) There are (at least) three (physical or virtual) wheels with equally-spaced, differentially spaced, or processor-weighted separate compartments.

2) Each compartment contains a symbol or character or characterization that distinguishes among compartments. Symbols my be any predetermined set of symbols (e.g., bells, lemons, plums, cherries, Sevens, Bars, Double Bars, Triple Bars, etc.), characters (Mahjong symbols, Asian figure characters, Roman numbers, astrological symbols, and the like) and characterizations (colors, stripes, checks, patterns, and the like).

3) Each of the wheels preferably has equal numbers of spaces for specific numbers as the other wheels, although in a less preferred embodiment (especially in a processor based, virtual wheels display), different numbers of compartments or slots may be present in one or more wheels. Those numbers are proposed to be between 28 and 36 spaces, and may be about 32 spaces.

4) The three physical wheels are preferably displayed in a full frontal display (in flat appearance, perspective, with or without topographic features or the like), so that each wheel can be independently and collectively viewed, each wheel independently selected for wagering, and individual outcomes on each of the three wheels can be viewed by players. Variations in the play of the games and displays of the wheel and views of the wheel (as explained later) may be provided with virtual wheels to control the size of the display.

5) Wagers are made on individual wheels, any multiple ones of the wheels (e.g., two of the wheels) or all three wheels. The wagers may be made electronically based on credits, credit, charged to an account, direct entry of coins, cash or tokens, ticket-in/ticket out wagers or any other way of placing value at risk.

6) Each wager operates or stands separately, in that a wager does not have to be won on the first wheel as a trigger or qualifier for a wager to be won against any other wheel.

7) Winning outcomes can depend upon collective events, but the individual outcomes on each wheel and for each wager are separately determined and there is no "pay line" as present in a standard slot-type gaming system.

8) The columns, slots or compartments in the wheel preferably contain either a single color from among 6 colors or individual symbols, with no secondary characteristic that can be wagered upon separately, that is there are no combinations of suits and ranks, symbols and colors and the like that must be combined to determine a single compartment symbol effect or outcome.

9) A side bet wager may be made that multiple identical symbols (e.g., 3 yellow color areas) will be obtained on a single spin of the three wheels. This side bet will be resolved according to a pay-table which differentiates awards among the different symbol that results from the spin of the three wheels.

10) The preferred mode is an electronic system with a random number generator determining individual wheel symbol outcomes or selecting template outcomes for spins of all three wheels. The system would comprise at least one video display, a processor system, memory and player input controls (e.g., button, switches or touch-screen entry system).

Additional technical enabling disclosure is provided herein.

A "display" as that term is used herein is an area that conveys information to a viewer. The information may be dynamic, in which case, an LCD, LED, CRT, LDP, rear projection, front projection, or the like may be used to form the display. The aspect ratio of the display may be 4:3, 16:9, or the like. Furthermore, the resolution of the display may be any appropriate resolution such as 480i, 480p, 720p, 1080i, 1080p or the like. The format of information sent to the display may be any appropriate format such as standard definition (SDTV), enhanced definition (EDTV), high definition (HD), or the like. The information may likewise be static, in which case, painted glass may be used to form the display. Note that static information may be presented on a display capable of displaying dynamic information if desired. Three dimensional imaging technology may also be provided for the images and the screen. Additionally, truncated perspectives may be provided on individual wheels to enhance ease of viewing the results on each wheel. For example, because there are three wheels, visual space on the screens must be optimized. Rather than being limited to showing a single view of the wheel with very small observable symbols, a portion of the virtual wheel may be magnified (in direct view or perspective) to increase the size of the symbols in the determination area (where the pointer determines the event outcome).

The present disclosure frequently refers to a "control system" or "processor" or "processor system." A control system, as that term is used herein, may be a computer processor coupled with an operating system, device drivers, and appropriate programs (collectively "software") with instructions to provide the functionality described for the control system. The software is stored in an associated memory device (sometimes referred to as a computer readable medium). While it is contemplated that an appropriately programmed general purpose computer or computing device may be used, it is also contemplated that hard-wired circuitry or custom hardware (e.g., an application specific integrated circuit (ASIC)) may be used in place of, or in combination with, software instructions for implementation of the processes of various embodiments. Thus, embodiments are not limited to any specific combination of hardware and software.

A "processor" means any one or more microprocessors, CPU devices, computing devices, microcontrollers, digital signal processors, or like devices. Exemplary processors are the INTEL PENTIUM® processor or AMD ATHLON® processors.

The term "computer-readable medium" refers to any medium that participates in providing data (e.g., instructions) that may be read by a computer, a processor or a like device. Such a medium may take many forms, including but not limited to, non-volatile media, volatile media, and transmission media. Non-volatile media include, for example, optical or magnetic disks and other persistent memory. Volatile media include DRAM, which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during RF and IR data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined below and includes many exemplary protocols that are also applicable here.

It will be readily apparent that the various methods and algorithms described herein may be implemented by a control system and/or the instructions of the software may be designed to carry out the processes of the present invention.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models, hierarchical electronic file structures, and/or distributed databases) could be used to store and manipulate the data types described herein. Likewise, object methods or behaviors of a database can be used to implement various processes, such as those described herein. In addition, the databases may, in a known manner, be stored locally or remotely from a device that accesses data in such a database. Furthermore, while unified databases may be contemplated, it is also possible that the databases may be distributed and/or duplicated amongst a variety of devices. Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols, such as Bluetooth™ TDMA, CDMA, 3G, 4G.

As used herein a "network" is an environment wherein one or more computing devices may communicate with one another. Such devices may communicate directly or indirectly, via a wired or wireless medium such as the Internet, LAN, WAN or Ethernet (or IEEE 802.3), Token Ring, or via any appropriate communications means or combination of communications means. Exemplary protocols include but are not limited to: Bluetooth™, TDMA, CDMA, GSM, EDGE, GPRS, WCDMA, AMPS, D-AMPS, IEEE 802.11 (WI-FI), IEEE 802.3, SAP, SAS™ by IGT, OASIS™ by Aristocrat Technologies, SDS by Bally Gaming and Systems, ATP, TCP/IP, gaming device standard (GDS) published by the Gaming Standards Association of Fremont Calif., the best of breed (BOB), system to system (S2S), or the like. Note that if video signals or large files are being sent over the network, a broadband network may be used to alleviate delays associated with the transfer of such large files, however, such is not strictly required. Each of the devices is adapted to communicate on such a communication means. Any number and type of machines may be in communication via the network. Where the network is the Internet, communications over the Internet may be through a website maintained by a computer on a remote server or over an online data network including commercial online service providers, bulletin board systems, and the like. In yet other embodiments, the devices may communicate with one another over RF, cable TV, satellite links, and the like. Appropriate encryption or other security measures such as logins and passwords may be provided to protect proprietary or confidential information.

A mobile terminal is defined to be a portable computing device such as a cellular telephone, a personal digital assistant (PDA), laptop computer, handheld computer, pager, or the like. An exemplary handheld gaming device that falls within the definition of a mobile terminal is the WifiCasino GS offered by Diamond I Technologies of Baton Rouge, La. Alternate exemplary mobile terminals are those developed by Motion Computing, Inc. of Austin, Tex., such as the LS800 Tablet PC running MICROSOFT WINDOWS XP Tablet PC edition. A description of the device is available at www.motioncomputing.com/products/tablet_pc_ls.asp. Another exemplary device has been developed by Hewlett-Packard Company of Palo Alto, Calif., such as the iPAQ hw6920 running MICROSOFT WINDOWS MOBILE for Pocket PC.

In the following descriptions, the use of the general term "wheels" includes purely, free-spinning wheels, processor and step motor controlled three individual reels, with one of ordinary skill in the art appreciating and understanding the technical implementations that are appropriate for the different mechanical and/or electronic systems.

Looking at FIG. 1, a full view of a screen shot of three wheels 20*a* 20*b* and 20*c* are shown with respective symbol position indicators or selectors 30*a* 30*b* and 30*c*. Individual characterization symbols of colors B (blue), G (Green), R (Red), W (White), Y (Yellow), V (Violet) and I (Indigo) are shown distributed randomly (but identically) about the three wheels 20*a* 20*b* and 20*c*. The screen 32 is a touchscreen having player input areas for wagering on each wheel separately 12*a* 12*b* and 12*c*, for wagering on all three wheel 14, for a special side bet 16, for selecting the amount of each wager 18 (e.g., by progressively touching area 18 the amount of the wager is increased) and for selecting a particular color for a wager 26 (wherein repeatedly touching area 26, a progression through the colors is made). Alternatively, there may be separate areas for each color, separate areas for each size of wager and a separate area to start each game (34). Other touch sensitive areas for cashing out, calling an attendant, and the like may also be provided.

One example of a method of play of the game can be performed as follows. The amount of an initial wager on an underlying game is made by repeatedly contacting area 18 on the touchscreen 32. A level of $5.00 per wager on the underlying wheel spinning game is made. Contact with area 26 scrolls through colors until a particular color (in this case B (Blue) is selected. Area 12*b* only is contacted to select the second wheel 20*b* as the underlying game object. No side bet is selected for this game play. The start button 34 is pressed and the three wheel 20*a* 20*b* and 20*c* are virtually spun, a random number generator (not shown) in the processor system (not shown) determining ultimate virtual wheel positions with respect to the pointers 30*a*. As an alternative, the wheels may appear to remain stationary and the pointers rotate about the wheels, or both the wheels and pointers may rotate with respect to each other.

In FIG. 1, a final position for the spin outcomes for the three wheels 20*a* 20*b* and 20*c* are shown as G (Green) for wheel 20*a*, B (Blue) for wheel 20*b* and B (Blue) for wheel 20*c*. As the wager in this game was directed towards only the second wheel (20*b*), only that outcome needs to be considered. As the outcome was the color B (Blue) wagered upon, the player wins the proportional amount awarded for that color when that outcome occurs (e.g., if a $5.00 wager is made and the return on the most prominent color (which Blue is) would be 1:1, so the player would retain his $5.00 wager and be paid an additional $5.00 award.

Again looking at FIG. 1, note sections 32*a* and 32*b* on the screen 32. The top section 32*a* may be a communal screen available to multiple players so that (like keno) the game may be played as a group or even theater event. In that case, players may have a screen or player input showing only bottom section 32*b* or may have both sections displayed on the player's individual screen 32. In this format, individual players may make their desired wagers on a communal game displayed on a central display area. Upon locking out further wagers, or completion of wagers at all active positions, or after expiration of a predetermined time period, the game is begun and a central processor resolves all wagers at each individual player position. The player input device in this format, as described above, may be any input/transmitting device known in the art.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models and/or distributed databases) could be used to store and manipulate the data types described herein. Likewise, object methods or behaviors of a database can be used to implement various processes, such as the described herein. In addition, the databases may, in a known manner, be stored locally or remotely from a device that accesses data in such a database.

Some embodiments can be configured to work in a network environment including a computer that is in communication, via a communications network, with one or more devices. The computer may communicate with the devices directly or indirectly, via a wired or wireless medium such as the Internet, LAN, WAN or Ethernet, Token Ring, or via any appropriate communications means or combination of communications means. Each of the devices may comprise computers, such as those based on the Intel® Pentium® or Centrino™ processor, that are adapted to communicate with the computer. Any number and type of machines may be in communication with the computer.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present disclosure.

Figure 3:
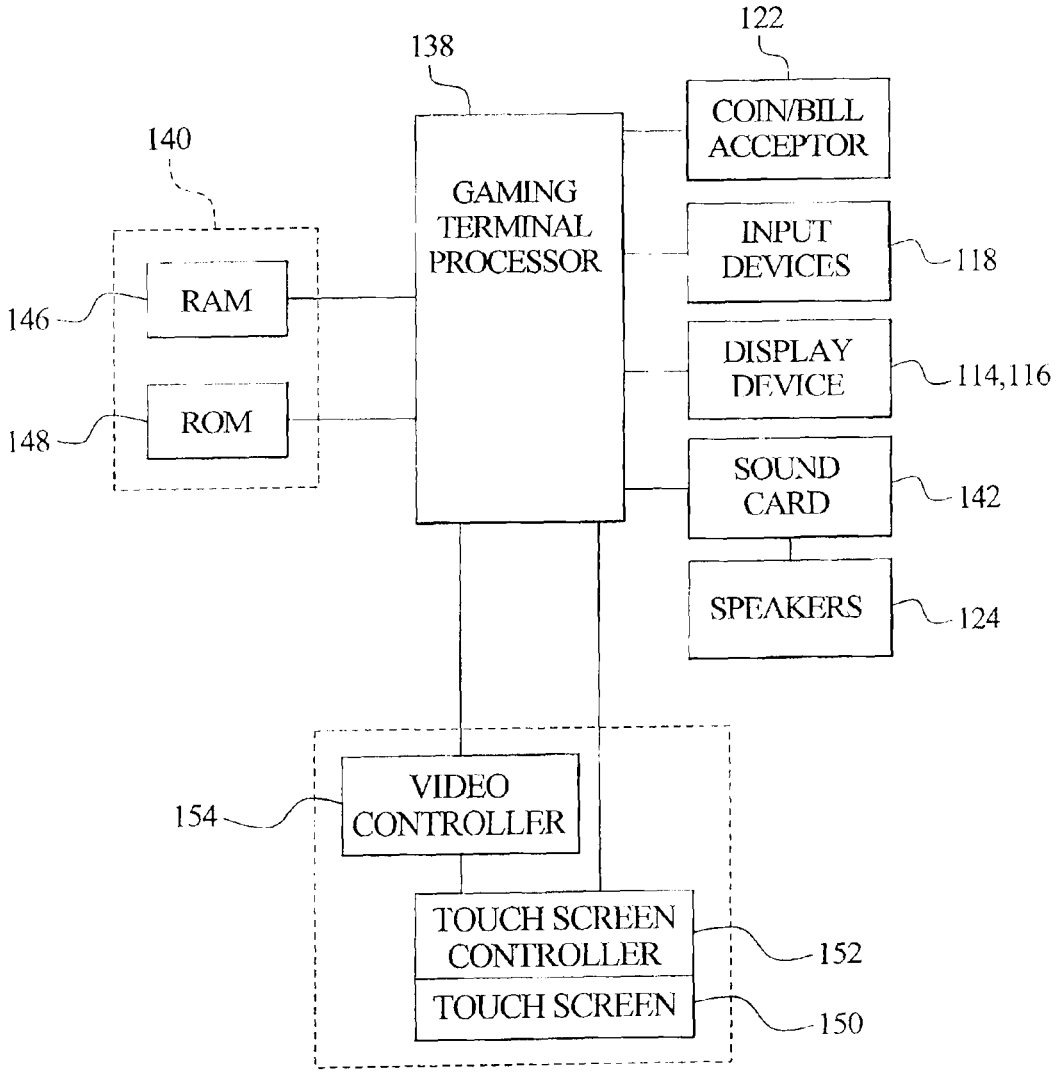
FIG. 3 shows a schematic or a typical terminal game system that may be used in practicing the present technology.

Referring now to FIG. 3, gaming terminal is run by a processor or central processing unit ("CPU") 138 and a memory device 140 that operates with one or more display devices 114 and 116 that display the generated wheels and associated game play information such as selected symbols. Processor 138 can be a microprocessor and have a microcontroller-based platform. The processor 138 is operable with a communication device which is in communication with the central controller. The memory device 140 includes random access memory ("RAM") 146 and read only memory ("ROM") 148. The platform for the processor 138 and memory device 140 can be: (i) inside the gaming terminal; or (ii) as stand alone components in the casino, part of a server/client system, data network, one or more application-specific integrated circuits (ASIC's), field programmable gated arrays (FPGA's) or one or more hard-wired devices. Furthermore, although the processor 138 and memory device 140 preferably reside on each gaming terminal 10 unit, it is possible to provide at least the function of selecting a game outcome seed (that is deterministic of a game outcome) from a pool or set of game outcome seeds, at a central location by a central controller such as a network server for communication to a playing station such as over a local area network (LAN), wide area network (WAN), Internet connection, microwave link, and the like.

Cabinets of gaming terminals also may provide a number of speakers 124 that operate via a soundcard 142 with processor 138 to inform the player of any type of output, outcome or instruction of gaming terminal 10. The gaming terminal provides an electromechanical input device 18 or simulated input device provided by a touch screen 150 that operates via a touch screen controller 152 and a video controller 154 with the processor 138. The input devices enable the player to operate the Keno gaming terminal of the present invention. One of the video monitors 114 and 116 and possibly, additionally the speakers 124 are used to explain: (i) when . . . ; (ii) how many . . . ; (iii) how much; and (iv) the type of award provided for obtaining the required number of matches.

The three wheel game of the present invention can include any suitable variation of wheel games. For purposes of the present invention, the game is illustrated in combination with the variation sometimes referred to as 'BIG 6' or Pacific Wheel. In this wheel game, one or more players play against the house.

In addition to winning base game credits, the gaming terminal 10, including any of the base games disclosed above, also includes secondary or bonus games that give players the opportunity to win credits. The gaming terminal 10 preferably employs a video-based display device 130 or 132 for the secondary or bonus games. The secondary or bonus games include a program that automatically begins when the player achieves a qualifying condition or a secondary game triggering outcome in the base game, such as a certain number of matches, a specific number matched or a any other suitable triggering event.

The game play of the wheel game of the present invention is initiated by a player inserting the appropriate amount of money or tokens at one of the plurality of gaming terminals in communication with the central controller. The gaming terminal enables the player to push one of the electromechanical pushbuttons or touch the touch screen that operates with the display device to select one or more numbers or game choices to play from a plurality of different player selectable numbers or game choices. It should be appreciated that while numbers are used to describe the present invention, any other suitable game choice such as symbols, images or indicia may be implemented with the keno game of the present invention.

What is claimed:

1. A method of providing a wagering game and resolving at least one wager on that wagering game comprising:

a) providing three independently spinning wheel outcome providers, each spinning wheel outcome provider having more than twenty outcome positions and up to 32 positions on each wheel;

b) each outcome position on the wheel having a symbol therein;

c) each spinning wheel outcome provider positioned on a gaming apparatus so that all symbols on a face of each spinning wheel outcome provider are viewable at the same time from a position in front of the gaming device;

d) each spinning wheel outcome provider having at least six different types of symbols or colors other than numbers displayed on the face of the spinning wheel outcome provider, using at least some repeating symbols or colors;

e) the gaming apparatus comprising the three spinning wheel outcome providers, a processor, memory accessible by the processor, and the processor configured to execute code to perform a method comprising:

$d_o$) recognizing at least one wager on the wagering game in which the wager places value at risk on the determination of at least one outcome selected from the group consisting of 1) any symbol appearing on any two spinning wheel outcome providers; and 2) any single symbol appearing on all spinning wheel outcome providers;

di) spinning each of the spinning wheel outcome providers;

dii) identifying a specific symbol outcome on each spinning wheel outcome provider; and diii) resolving any wager recognized in $d_o$ 1) or $d_o$ 2) based upon the identification of each specific symbol outcome on each spinning wheel outcome provider.

2. The method of claim 1 wherein each spinning wheel outcome provider consists of a physical spinning wheel with an axis or rotation perpendicular to the face of the spinning wheel outcome provider.

3. The method of claim 1 wherein each spinning wheel outcome provider consists of a virtual spinning wheel with a virtual axis or rotation perpendicular to the face of the spinning virtual wheel outcome provider which is displayed on a video display system upon execution of code by a processor.

4. The method of claim 1 wherein two separate wagers are recognized at a single player position, the two separate wagers comprising a) at least one wager on an outcome of a specific symbol on a specific wheel, a specific symbol on at least two wheels, or a specific symbol on three wheels and b) an outcome of any specific symbol on three wheels or any single symbol on all three wheels.

5. The method of claim 2 wherein two separate wagers are recognized at a single player position, the two separate wagers comprising a) at least one wager on an outcome of a specific symbol on a specific wheel, a specific same symbol on at least two wheels, or a specific same symbol on three wheels and b) an outcome of any same specific symbol on three wheels or any same symbol on all three wheels.

6. The method of claim 3 wherein two separate wagers are recognized at a single player position by the processor, the two separate wagers comprising a) at least one wager on an outcome of a specific virtual symbol on a specific virtual wheel, a specific same virtual symbol on at least two virtual wheels, or a specific same virtual symbol on three virtual wheels and b) an outcome of any same specific virtual symbol on three virtual wheels or any single same virtual symbol on all three wheels.

7. The method of claim 3 wherein at least two separate wagers are recognized by the processor at a single player position, the at least two separate wagers comprising a first wager on a first symbol on a first wheel and a second wager on a second symbol different from the first symbol on a second wheel.

8. The method of claim 3 wherein the processor executes code to display exactly six different symbols within the symbol positions, with exactly one symbol within each symbol position, with at least three of the symbols being randomly distributed among the symbol positions and the at least three of the symbols being present on a single wheel in numerically different quantities.

9. The method of claim 6 wherein the processor executes code to display exactly six different symbols within the symbol positions, with exactly one symbol within each symbol position, with at least three of the symbols being randomly distributed among the symbol positions and the at least three of the symbols being present on a single wheel in numerically different quantities.

10. The method of claim 3 wherein contact with a defined area on a touchscreen identifies a specific wheel or combination of wheels for the recognized at least one wager.

11. The method of claim 6 wherein contact with a defined area on a touchscreen identifies a specific wheel or combination of wheels for the recognized at least one wager.

12. The method of claim 8 wherein contact with a defined area on a touchscreen identifies a specific wheel or combination of wheels for the recognized at least one wager.

13. The method of claim 9 wherein contact with a defined area on a touchscreen identifies a specific wheel or combination of wheels for the recognized at least one wager.

14. The method of claim 3 wherein the virtual wheels are displayed on a communal screen and at least one wager on the wagering game is recognized at each of at least two separate player positions.

15. The method of claim 6 wherein the virtual wheels are displayed on a communal screen and at least one wager on the wagering game is recognized at each of at least two separate player positions.

16. The method of claim 14 wherein at least one player position consists of a player terminal in data transmission communication with the processor.

17. The method of claim 15 wherein at least one player position consists of a player terminal in data transmission communication with the processor.

18. A method of providing a wagering game and resolving at least one wager on that wagering game comprising:

a) providing three independently spinning wheel outcome providers, each spinning wheel outcome provider having only 28-32 outcome positions on each wheel;

b) each outcome position on the wheel having i) a symbol or ii) a color without a symbol therein;

c) each spinning wheel outcome provider positioned on a gaming apparatus so that all symbols on a face of each spinning wheel outcome provider are viewable at the same time from a position in front of the gaming device;

d) each spinning wheel outcome provider having at least six different types of symbols displayed on the face of the spinning wheel outcome provider, and at least some of the at least six different types of symbols repeating among outcome positions;

e) the gaming apparatus comprising the three spinning wheel outcome providers, a processor, memory accessible by the processor, and the processor configured to execute code to perform a method comprising:

$d_o$) recognizing at least one wager on the wagering game in which the wager places value at risk on the determination of at least one outcome selected from the group consisting of 1) a specific symbol appearing on a specific spinning wheel outcome provider; 2) any symbol appearing on any two spinning wheel outcome providers; 3) any single symbol appearing on all spinning wheel outcome providers; and 4) a specifically selected single symbol appearing on all spinning wheel outcome providers;

di) spinning each of the spinning wheel outcome providers;

dii) identifying a specific symbol outcome on each spinning wheel outcome provider; and diii) resolving any wager recognized in $d_o$) 1) or $d_o$) 2) $d_o$) 3) or $d_o$) 4) based upon the identification of each specific symbol outcome on each spinning wheel outcome provider.

19. The method of claim 18 wherein at least one wager is recognized from the group consisting of:

1) any symbol appearing on any two spinning wheel outcome providers; and 2) any single symbol appearing on all spinning wheel outcome providers, and di) and dii) are repeated and the wagers of 1) any symbol appearing on any two spinning wheel outcome providers and 2) any single symbol appearing on all spinning wheel outcome providers are resolved based upon the identification of each specific symbol outcome on each spinning wheel outcome provider.

20. The method of claim 18 wherein the processor executes code to display exactly six different symbols within the symbol positions, with exactly one symbol within each symbol position, with at least three of the symbols being randomly distributed among the symbol positions and the at least three of the symbols being present on a single wheel in numerically different quantities.

* * * * *